US005346089A

United States Patent [19]

Brown et al.

[11] Patent Number: 5,346,089

[45] Date of Patent: Sep. 13, 1994

[54] PRODUCE PACKAGING AND METHODS OF SEALING SAME

[76] Inventors: Richard S. Brown, 34325 Chualar Canyon Rd.; Bennett W. Brown, 34012 Chualar Canyon Rd., both of, Chualar, Calif. 93925

[21] Appl. No.: 916,400

[22] Filed: Jul. 20, 1992

[51] Int. Cl.[5] ..... B65D 33/00

[52] U.S. Cl. ..... 220/403; 383/89

[58] Field of Search ..... 220/400, 403, 404; 383/52, 88, 89

[56] References Cited

U.S. PATENT DOCUMENTS

| | | | |
|---|---|---|---|
| 2,170,378 | 8/1939 | Orstrom | 220/403 X |
| 2,214,944 | 9/1940 | Vogt | 220/403 X |
| 2,335,913 | 12/1943 | Buttery | 220/403 X |
| 3,128,934 | 4/1964 | Jacke | 220/403 |
| 3,484,017 | 12/1969 | O'Donnell | 220/404 X |
| 4,759,642 | 7/1988 | Van Erden | 220/403 X |
| 4,930,906 | 6/1990 | Hemphill | 383/89 |
| 4,963,287 | 9/1989 | Marsik | 383/89 X |
| 5,044,776 | 9/1991 | Schramer et al. | 383/89 |
| 5,078,509 | 1/1992 | Center et al. | 383/89 X |

*Primary Examiner*—Steven M. Pollard
*Attorney, Agent, or Firm*—Robert J. Schaap

[57] ABSTRACT

An environmentally sealed packaging system for the storage and transport of vegetables which relies upon one or more plastic bags and which may be contained in suitable paperboard containers. The plastic bags are usually of a large size and have a substantial thickness in order to withstand the rigors of transport and storage. Nevertheless, they are flexible and foldable. When produce, and particularly vegetables such as lettuce, is stored in the plastic bags, the upper ends are sealed by engaging two opposed outer side walls and rolling the two outer side walls together to form an enlarged roll. The ends of the roll are then folded inwardly and secured to the top in order to seal the opposite transverse ends. The rolling of the bags effectively seals the two sides together and with the folding of the ends the interior of the bag is then sealed. A releasable tape is then secured to the folded-in ends and to the roll in order to thereby hold the bag in a closed condition. When it is desired to reopen the bags, it is only necessary to peel the tape from the plastic bags. Various modes of tape placement are disclosed.

8 Claims, 4 Drawing Sheets

PRODUCE PACKAGING AND METHODS OF SEALING SAME

BACKGROUND OF THE INVENTION

1. Field of the Invention:

This invention relates in general to certain new and useful improvements in environmentally sealed packaging for vegetables and more particularly, to an improved sealed plastic container and a method of sealing the same.

2. Brief Description of the Prior Art:

One of the principal problems encountered in the storage and transport of produce, such as lettuce, is the fact that the lettuce or other produce will rapidly deteriorate if maintained in an oxygen-existing environment, even though it may be refrigerated. It would therefore be desirable to seal the lettuce or other produce in plastic containers which can be sealed to render them sealed with respect to the external atmosphere. In this way, the atmosphere inside of the plastic container or bag can be altered so as to provide a relatively oxygen-free atmosphere.

One of the principal problems encountered in the storage and transport of many forms of produce, such as lettuce, is the inadvertent introduction of foreign matter in the produce. The use of metal in the produce is one of the most common and also one of the most serious potential hazards which can arise. Very often, in order to open plastic bags or like containers, the workers who handle the produce in processing locations will utilize knives and even razor blades for purposes of cutting open the plastic bag or other container. Unfortunately, on occasions, the blade of the knife or a piece of the razor blade may snap from the main body of the knife or blade and thus become deposited on a conveyor belt along with heads of lettuce. Very often, the personnel fail to discover the existence of that piece of metal. Very frequently, the processing plant personnel will fail to recognize or discover the piece of metal mixed with the vegetables such as the lettuce. Moreover, these pieces of metal can become literally entrapped in the lettuce. If they are not discovered during cleaning of the lettuce, they can end up in an individual's food. Clearly, when ingested the metal can cause serious injury and damage to an individual thereby resulting in exposure of liability, not only to the processor but to all involved in the chain of handling that produce.

In order to reduce the incidence of metal contamination, many processing facilities have literally resorted to the use of metal detectors for attempting to locate foreign metal bodies which may be moved along with or otherwise become entrapped in the produce. However, in view of the fact that many of the pieces of equipment used in processing of the produce are constructed of metal, the metal detectors are often times of limited value.

Many processing facilities impose strict rules on the use of metal containing objects at or near the processing lines which contain the produce or other food products. Further, in the duties of their occupation, the workers who are responsible for processing of the food product, will disregard the imposed rules and resort to the use of knives, razor blades or the like in order to open packages.

Some packages of food items have made available small bags where the food product is contained in the bag and the upper lips are rolled over upon one another to seal the bag. Moreover, these bags are provided with a bendable wire capable of being folded over the rolled portions of the bag. Certain coffee products are found this type of bag. However, in this case, the metal wire is incorporated into the bag and literally becomes a part of the bag.

OBJECTS OF THE INVENTION

It is, therefore, one of the primary objects of the present invention to provide environmentally sealed packaging for food items such as produce which can be easily sealed and opened without the need for external opening implements.

It is another object of the present invention to provide environmentally sealed packaging for produce of the type stated which utilizes a rolling of the open upper ends of a plastic container and sealing the same with a strip of tape.

It is also an object of the present invention to provide environmentally sealed packaging of the type stated for storage and transport of produce and in which an upper end is sealed in such manner that external implements, such as knives and the like, are not required to open same.

It is still another object of the present invention to provide environmentally sealed packaging for produce of the type stated in which an open end of the container can be sealed with adhesive strips internally applied to opposed side walls of the container.

It is a further object of the present invention to provide environmentally sealed packaging for produce of the type stated in which a snap-type lock arrangement may be used for securing two opposed side walls of a container and then sealing end portions thereof to the top wall of the container thus formed.

It is still a further object of the present invention to provide environmentally sealed packaging for produce of the type stated which relies upon rolling of the open upper ends of the container and thereafter folding over of the transverse ends of the roll onto the roll itself and sealing the same with tape to provide a complete airtight inner compartment.

It is an additional object of the present invention to provide a method of sealing a food product in a plastic bag by rolling the upper ends of the plastic bag over upon one another to form the roll and then folding the transverse ends of the bag inwardly on top of the roll and sealing them together with tape.

It is another salient object of the present invention to provide both an environmentally sealed container as well as a method of sealing containers which is highly effective in use and is also quite safe and results in little or no metal contamination of the food products contained therein.

With the above and other objects in view, our invention resides in the novel features of form, construction, arrangement and combination of parts and components presently described and pointed out in the claims.

BRIEF SUMMARY OF THE INVENTION

The present invention relates in general to environmentally sealed packaging for vegetables, such as produce in the nature of lettuce and the like. The invention primarily relates to the sealing aspects for sealing plastic containers used for these vegetables without the attendant danger of contamination.

It has been found in connection with my co-pending patent application Ser. No. 915,093 filed Jul. 16, 1992, lettuce and other produce can be effectively stored and transported in double plastic liners, that is, one liner located inside of another liner with a modified atmosphere in each of the liners. The present invention is highly effective in sealing each of those liners which may be located in an outer paperboard container. However, the invention is also effective in sealing any type of plastic container which is designed for the storage and/or transport of produce such as vegetable products.

Generally, the upper end of the container, which is sometimes referred to as a "liner" since it is inserted into a paperboard box-like construction or so-called "carton", is gusseted In accordance with this construction, there is oftentimes an excess of material at the upper end of the container. When the container or liner is folded at its transverse ends, usually by creases, two opposed walls are effectively formed. These walls are essentially brought into contact with one another and then sealed by any one of several methods which may be employed in accordance with the present invention.

One of the preferred methods employed for sealing the initially opened upper end of the container is that of folding creases along two opposed transverse ends and bringing the two longitudinal walls thus formed into interior facewise contact with one another at least at the upper ends thereof. The excess material at the upper end of these walls is then rolled in the form of a continuous roll downwardly until the roll engages the produce, such as the vegetables, which are packaged in the container. Further, by forming a continuous roll which increases in diameter as the rolling process continues, there is an effective top wall formed on the container.

In accordance with the invention, the initially opened end of the plastic container is rolled over using successive increments of the side walls to form the diameterally increasing roll which moves downwardly upon itself. This technique has been found highly effective in sealing the upper end of the container. In fact, it has been found that the inner chamber of the container is essentially environmentally sealed with respect to the external atmosphere merely by forming a roll of the plastic sheet material.

When the roll has been completed and engages the upper surface of the produce in the container, due to the gusseted construction of the container, two opposed transverse end sections are formed. These end sections are preferably folded over and disposed on top of the roll itself. In this way, the end sections can be secured to either the roll or the top wall of the container, or both, by means of simple adhesive tape strips.

In accordance with the above-identified construction, it can be observed that it is only necessary for someone intending to open the container to merely remove the adhesive strips. After removal of the adhesive strips, it is a very simple process to merely unroll the roll that was previously formed thereby providing immediate access to the interior of the container. It can be observed that with this approach, there is no need of external implements of any kind which might result in metal contamination of the produce.

In another method of the present invention, it is possible to merely bend the elongate transverse ends over onto the side of the container or otherwise, the side of the paperboard box in which the container may be located and then secure the same to the sides with adhesive strips. It is also possible in accordance with the present invention to use an adhesive strip located on the inner surface of the one of the walls of the plastic container Thus, this strip would be initially placed on the container during the manufacture thereof and would be covered with a releasable cover or so-called "backing."

After the container had been creased along two opposed transverse ends, the two thus formed side walls are brought into contact with one another. The plastic adhesive strip on the inside of one of the side walls thereupon engages the opposite side wall adjacent the upper end in order to secure the same. The excess material can then be folded over and placed onto the top wall of the container and secured thereto.

In still another method of sealing the upper end of the container, a plastic flange formed in the inner surface of one container wall can be snap-fitted into a groove in the opposite wall of the container, much in the nature of a so-called "Zip-Lock" plastic container. However, in this case, since there may not be an effective air-tight seal, particularly for retaining an inert atmosphere in the nature of carbon monoxide, it might be necessary or desirable to provide excess material at the ends of the container which can be folded over and secured to the top wall of the container with adhesive strips. In accordance with this construction, it is not necessary to roll the upper end of the container down upon the produce in order to form a top wall, but it would be necessary to adhesively secure the transverse end sections of the container to the top wall thereof.

In all cases, it can be observed that the container is easily openable without the need of any external implement inasmuch as it is only necessary to either spread apart two side walls of a container or remove adhesive strips or the like. In all cases, there is no need for external implements, such as knives, razor blades or the like and as a result, there is little or no possibility of metal contamination.

The present invention has many other objects and other advantages and purposes which will become more clearly apparent from consideration of the forms in which it may be embodied. Several of these forms are shown in the accompanying drawings and described in the detailed description. However, it is to be understood that these drawings and the detailed description are set forth only for purposes of illustrating and describing the general principals of the invention and are not to be taken in a limiting sense.

BRIEF DESCRIPTION OF THE DRAWINGS

Figure 1:
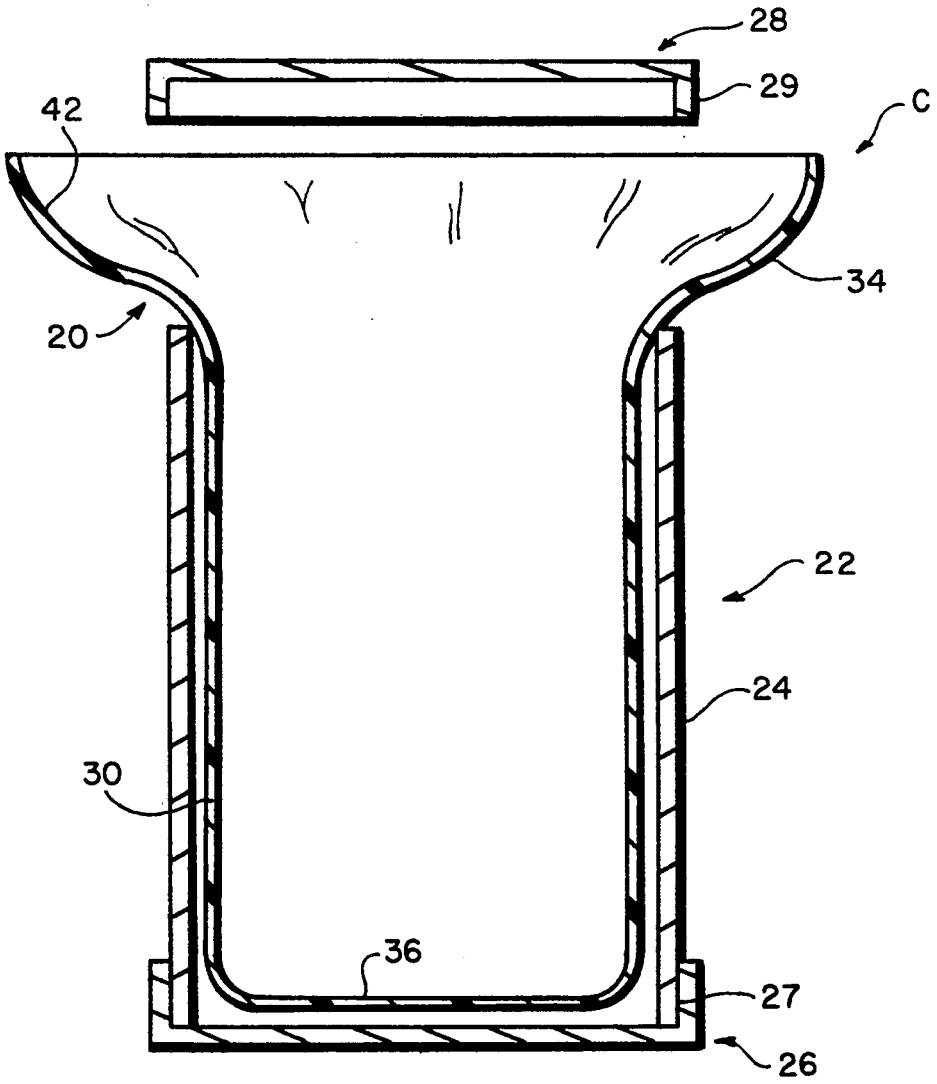
Figure 2:
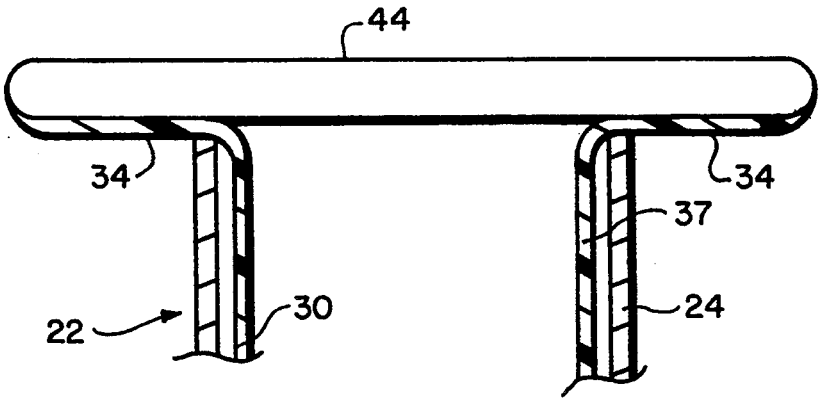
Figure 3:
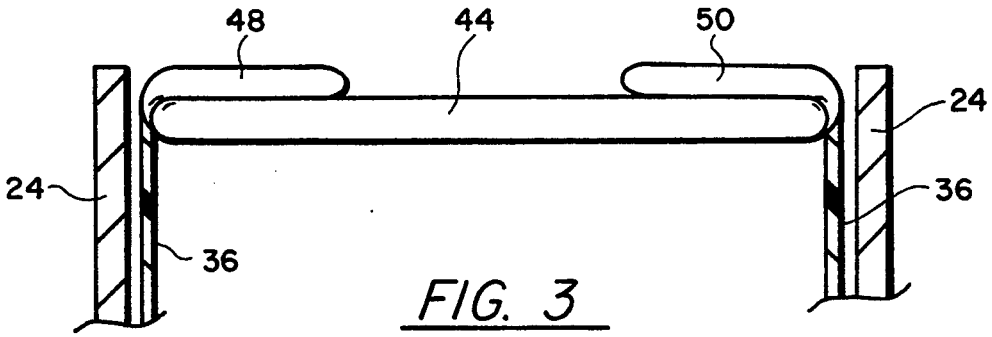
Figure 4:
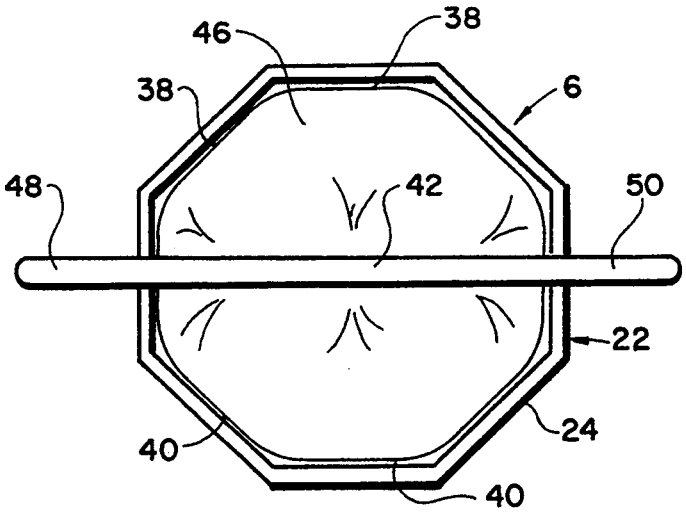
Figure 5:
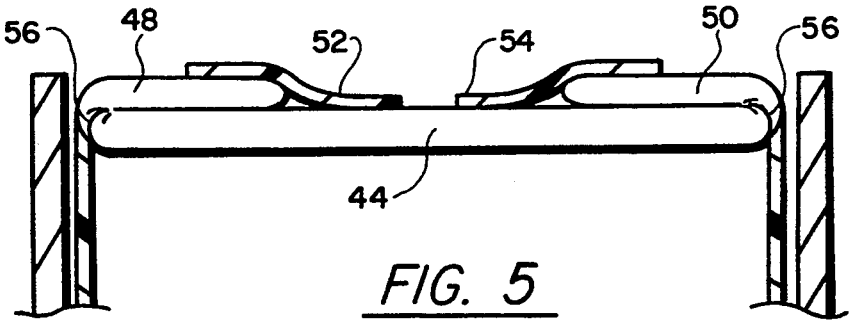
Figure 6:
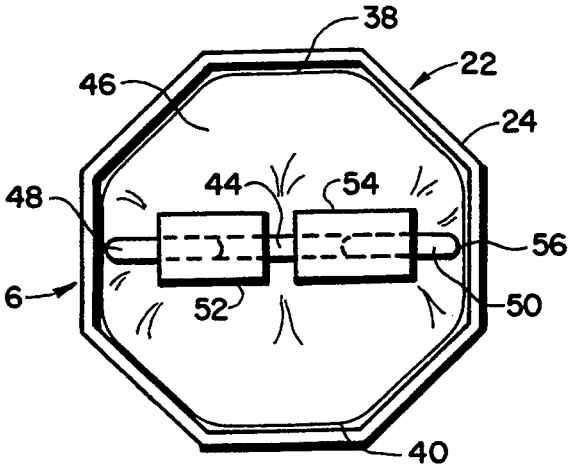
Figure 7:
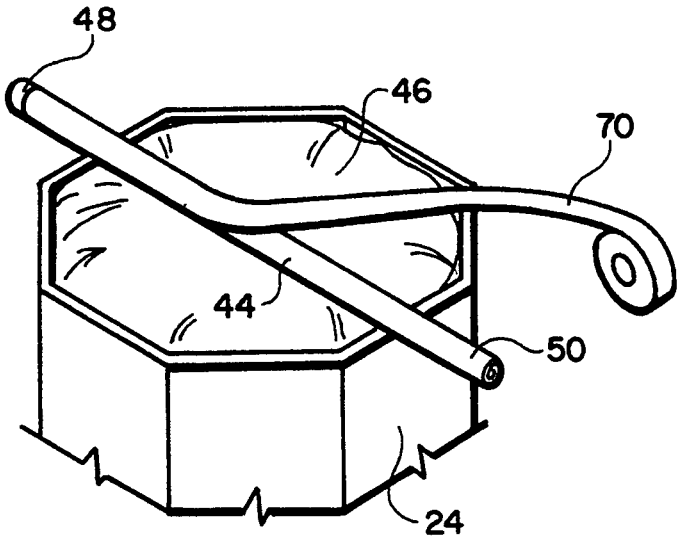
Figure 8:
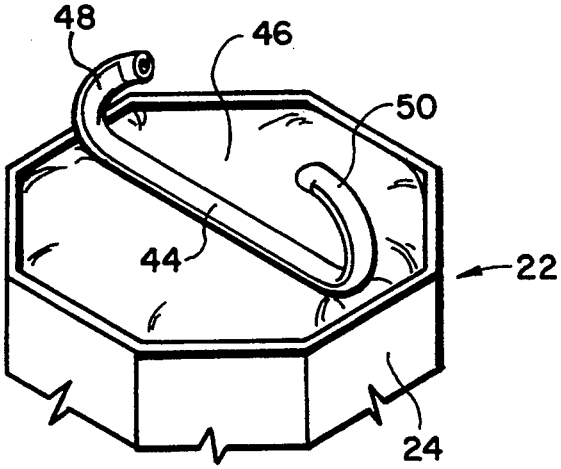
Figure 9:
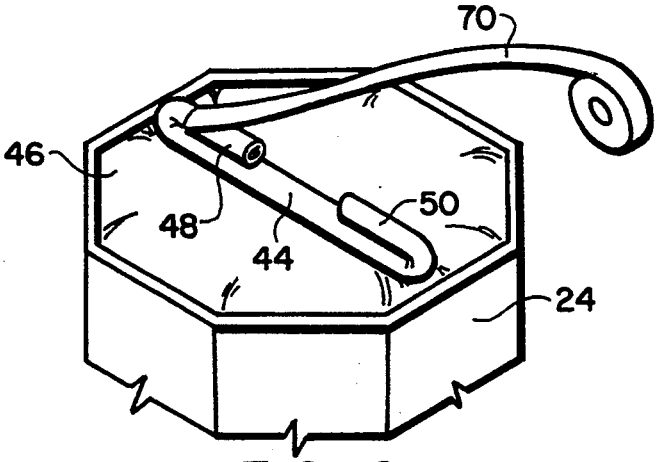
Figure 10:
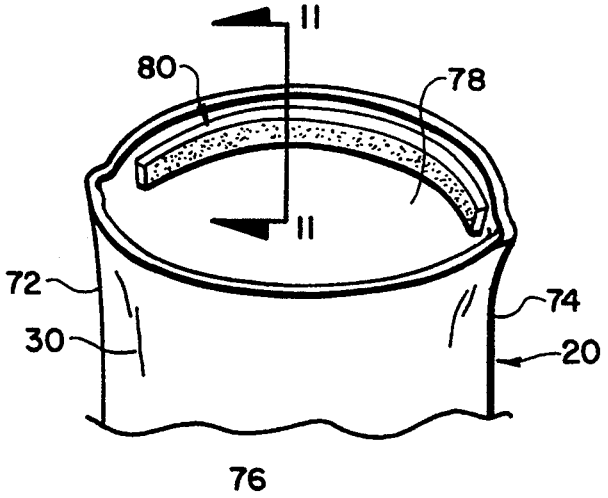
Figure 11:
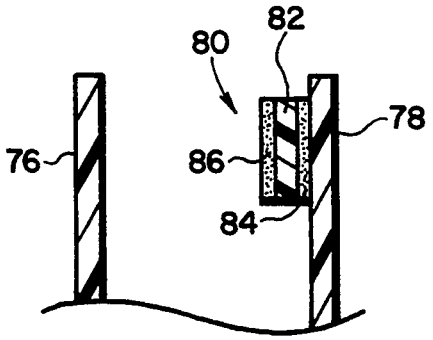
Figure 12:
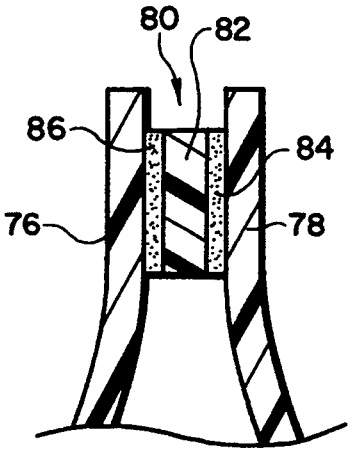
Figure 14:
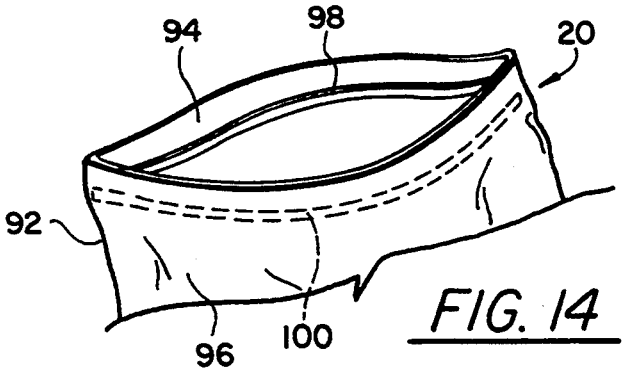
Figure 13:
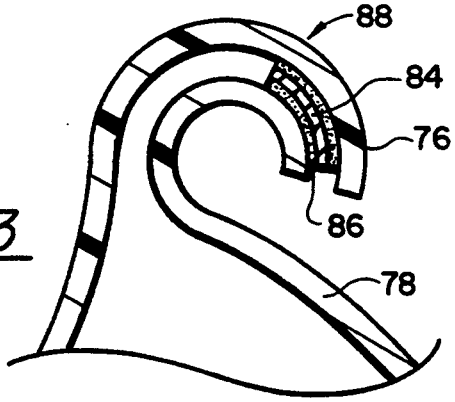

Having thus described the invention in general terms, reference will now be made to the accompanying drawings (four sheets) in which:

FIG. 1 is an exploded vertical sectional view of a container system for use in storage and transport of produce and like food products and showing a plastic container located within a shipping box or carton forming part of the container system;

FIG. 2 is a fragmentary vertical sectional view showing the upper end of the plastic container after the upper portions thereof have been rolled into the form of an upper sealing roll;

FIG. 3 is a fragmentary vertical sectional view showing a folding of transverse end sections of a roll onto the top of the roll of a container in order to seal same;

FIG. 4 is a top plan view of the container of FIG. 3;

FIG. 5 is a fragmentary vertical sectional view, similar to FIG. 3, and showing the use of adhesive strips for securing the transverse end sections of a roll to the top of the roll;

FIG. 6 is a top plan view of the container arrangement as shown in FIG. 5;

FIG. 7 is a fragmentary perspective view of a modified form of method for securing the transverse end sections of a roll forming part of a container to a side wall of the container or a box therefor;

FIG. 8 is a fragmentary perspective view, somewhat similar to FIG. 7, and showing the folding of transverse end sections of a roll onto the top of the roll;

FIG. 9 is a fragmentary perspective view showing the application of an adhesive tape strip to transverse end sections of a roll disposed on the top of the roll;

FIG. 10 is a fragmentary perspective view of a modified form of container construction utilizing a modified method for sealing the container in accordance with the present invention;

FIG. 11 is a fragmentary vertical sectional view taken substantially along line 11—11 of FIG. 10;

FIG. 12 is a fragmentary vertical sectional view, somewhat similar to FIG. 11, and showing the two opposed side walls of a container secured to one another;

FIG. 13 is a fragmentary vertical sectional view, somewhat similar to FIGS. 11 and 12, and showing the rolling of the upper portion of the container of FIGS. 11 and 12 in order to form a top seal thereof; and FIG. 14 is a fragmentary perspective view showing still another modified form of container construction and a method of sealing same in accordance with the present invention.

DETAILED DESCRIPTION OF PREFERRED EMBODIMENTS

Referring now in more detail and by reference characters to the drawings which illustrate several preferred embodiments of the present invention, C designates a container assembly constructed in accordance with and embodying the invention and used for the storage and/or transport of produce. The container construction C generally comprises two major components which are a plastic container, often referred to as a "liner" 20 and a box-like shipping carton 22;

The shipping carton 22 may be formed of a paperboard container, as aforesaid, and preferably a corrugated paperboard container material. The shipping carton 22 has a side wall 24 and preferably, a polygonal side wall, such as an octagonally shaped side wall 26, along with a bottom section 26. The bottom section can be secured to the side wall 24 by means of an upturned peripheral flange 28 without the need for staples or other mechanical fasteners. In this way, there is provided a container assembly which is completely devoid of any metal, including metal fasteners.

A top lid 28 is also provided for the container assembly with a peripherally extending, downwardly struck flange 29 for disposition over the upper edge of the side wall 24. Here again, the lid can be removably fitted on the top of the carton and therefore, again, staples and like mechanical fasteners are not required. This type of construction is also more fully illustrated and described in the aforesaid co-pending patent application.

The plastic liner or container 20, as illustrated in FIG. 1, includes a continuous side wall 30 and which may be gusseted, as previously described. However, the side wall, due to the excess material provided by the gusseted construction, is provided with an outwardly flaring upper end 34. The side wall is enclosed at its lower end by means of a bottom wall 36 integrally formed therewith.

The liner or container 20 is preferably formed of any of a number of suitable plastic materials, such as polyethylene or the like. However, various vinyl acetates or ethyl vinyl acetate, for example, may be used in the construction of the container. It is important, however, that the container be of a construction which is foldable and flexible. Moreover, the container must be formed of a material which is relatively air-impervious. In this way, when the container is sealed with produce located therein, the oxygen containing air can be evacuated and recharged with an inert, relatively oxygen-free atmosphere, such as carbon monoxide. Further, and while the container itself should be flexible and foldable, it should nevertheless be of a suitable thickness to withstand the rigors normally encountered in the shipping, storage and transport of produce.

When using the container assembly of the present invention, as illustrated in FIG. 1, the upper end thereof is initially opened, as illustrated. Produce, such as vegetable heads or the like, are then introduced into the container when the latter has been fitted into a box-like carton 22 and is then filled to a desired level. Usually, the lettuce heads, or other produce, are filled in the container 20 until they reach a level approximately equal to the upper edge of the carton 22.

After the container has been filled, the side wall 24 is creased at two transverse edges 37, as best illustrated in FIG. 2. The creasing of the two edges 37 essentially forms a container of two opposed side wall sections 38 and 40, as best illustrated in FIG. 4. The opposed side wall sections are brought into intimate contact with one another so that the inner surfaces of each of the side wall sections 38 and 40 are in intimate contact. The excess material 42 at the upper end of the side wall sections is then rolled over in the form of a roll 44. The roll 44 will literally be comprised of a pair of opposed side wall sections in intimate contact with one another and the rolling continues until the roll 44 thus formed engages the produce, or other food product, located within the container 20. Furthermore, the formation of the roll and the rolling of the excess material into this roll 44 literally creates a top wall 46 of the container, as shown in FIGS. 3 and 4 of the drawings.

As indicated previously, the outwardly flared upper end 34 forms two transverse end sections 48 and 50 on the roll, as best illustrated in FIG. 4. At this point in the process, the container 20 is generally sealed, due to the fact that there are several turns in the roll 44. However, the transverse end sections 48 and 50 of the roll must folded in, in order to enable disposition of a lid 28 on the carton 22. These transverse end sections 48 and 50 are thereupon folded over and disposed on the upper surface of the roll, as best illustrated in FIG. 3 of the drawings.

The transverse end sections 48 and 50 are suitably secured to the roll 44 or otherwise to the top wall 26 of the container 20 or both, by means of adhesive tape strips 52, as best illustrated in FIGS. 5 and 6 of the drawings. It should be understood that as the end sections 48 and 50 are folded over, they actually form creases 56 at the transverse ends which further seals the two ends sections 48 and 50 with respect to the interior of the container 20. Further, the adhesive strips 52 and 54 are effective in that they hold the transverse end sections 48 and 50 onto the top wall 46, thereby precluding their interference with the placement of a lid or like structure on the upper end of the carton 22.

The use of transverse end sections 48 and 50 to fully and completely seal the interior of the container is effective when folded over and held with releasable adhesive strips, such as the strips 52 and 54. By means of this construction, one who must obtain access to the interior of the container can merely engage the ends of the adhesive strips and pull the same so that the transverse end sections 48 and 50 are released. By folding the transverse end sections 48 and 50 outwardly to the position as shown in FIG. 4, it is only a simple task to merely unroll the material formed in the roll and thereby obtain access to the interior of the container 20. This construction completely eliminates the need for knives or other metal implements, or the like, in order to obtain access to the interior of the container. Furthermore, since the carton 22 itself may be constructed without staples or other metal fasteners, there is no metal in the entire container assembly C and hence, little or no likelihood of metal contamination with the produce.

FIGS. 7–9 illustrate a further embodiment of the present invention in which like reference numerals will designate like components of the embodiment, as illustrated in FIGS. 1–6. In the embodiment, as illustrated in FIGS. 7–9, there is also a roll 44 and which is disposed on the formed top wall 46 and also provided with a pair of transverse outwardly flared end sections 48 and 50. In this case, a continuous strip of adhesive tape 70 is applied to both the transverse end sections 48 and 50 and the roll 44. In the embodiment as illustrated, the transverse end sections 48 and 50 may be also secured to the side wall 24 of the carton 22. In this case, the lid 28 would be sized to accommodate the slight additional thickness of the transverse end sections 48 and 50. In like manner, if desired, these transverse end sections 48 and 50 may be tucked into the carton and secured to the side wall sections of the container 20.

FIGS. 8 and 9 illustrate an embodiment where the transverse end sections 48 and 50 are folded over to be disposed on the top of the roll 44, also in the manner as illustrated in connection FIGS. 1–6 of the drawings. However, in this embodiment, the transverse end sections 48 and 50 are secured by a single piece of tape 70 dispensed from a roll of the tape. These techniques for securing the end sections 48 and 50 of the roll 44 are equally as effective as those illustrated in FIGS. 1–6 of the drawings.

FIGS. 10–13 illustrate still a further embodiment of the invention showing another container construction and associated process for sealing the upper end of the container. Here again, like reference numerals will represent the same components, as illustrated in FIGS. 1–9 of the drawings.

In the container construction, as illustrated in FIGS. 10–13, the side wall 30 of the container 20 may also be creased to form creases 72 and 74 at each of the transverse ends 48 and 50. These creases 72 and 74 similarly form a pair of opposed side wall sections 76 and 78, as best illustrated in FIGS. 10 and 11 of the drawings. When fully creased, the two side wall sections 76 and 78, which are opposed to one another, can then be brought into facewise contact with one another.

The inner surface of the side wall section 78 is provided with a double adhesive tape section 80. By reference to FIG. 11, it can be seen that this tape section 80 is comprised of an inner layer 82 having a first layer which is an adhesive layer 84 for disposition against the side wall sections 78 and a second or outer adhesive layer 86 on the opposite side of the intermediate layer 82. The outer adhesive layer 86 is preferably covered by a suitable releasable cover, or so-called "backing" (not shown). When the releasable backing is removed, the outer adhesive strip 86 is then brought into contact with the interior surface of the side wall section 76 to form a relatively tight seal therebetween, as best illustrated in FIG. 12 of the drawings.

The use of an adhesive, in and of itself, may not be sufficient to form an air-tight seal so as to hold a relatively inert atmosphere within the container itself. Consequently, the container is also formed with a slight amount of excess material at the upper end and which can be rolled in the form of a roll 88, as illustrated in FIG. 13 of the drawings. However, due to the fact that there is an adhesive strip securing the two opposed side wall sections 76 and 78, there is only a need for a relatively few turns to form the roll. Thereafter, if desired, the transverse end sections 76 and 78 are again inwardly turned to be disposed over the roll and secured to the roll or the top wall 46 of the container 20, or both, in the manner as illustrated in FIG. 5 and 6 of the drawings.

FIG. 14 illustrates yet a further embodiment of the present invention which utilizes a slightly different means for securing two opposed side walls of a container together. Again, like reference numerals will represent like components in the container construction as illustrated in FIGS. 1–13 of the drawings.

In the embodiment of the invention, as illustrated in Figure 14, the container 20 may also be creased along its transverse edges 90 and 92 to form a pair of opposed side wall sections 94 and 96. The interior surface of one of the side wall sections 94 is provided with an elongate narrow projection 98 which is capable of fitting into an elongate narrow groove 100 formed in the opposite side wall section 96. This type of construction is similar to that used in the so-called "Zip-Lock" container for the storage of relatively small items. In accordance with this construction, the elongate projection or ridge 98 can actually be snap-fitted into the groove 100 where it is frictionally held therein to hold the two side wall sections together. Again, this type of construction may or may not be sufficient to maintain an air-tight seal for retention of an inert relatively oxygen-free gaseous atmosphere in the container 20. Thus, and in this case, excess material would also be formed at the upper end of the container 20 which is again rolled upon itself to form a roll and with the transverse ends 90 and 92 secured to the roll 88, all in the manner as illustrated in FIGS. 3–6 of the drawings.

It should be understood that the above-described embodiments are only certain of the embodiments which can be used for securing the upper end of the initially open container in the form of an air-tight seal. In general, any means within the scope of this invention for securing the upper end of the container side wall to form an air-tight seal without the need of mechanical fasteners can be employed. Preferably, any means of sealing the container must rely upon non-metallic and easily removable or releasable elements, such as the "Zip-Lock" type construction or the use of adhesive material or the like.

Thus, there has been illustrated and described unique and novel container constructions which are effective for the storage and/or transport of produce, as well as associated methods of sealing these containers. The present invention therefore fulfills all of the objects and advantages which have been sought. It should be understood that many changes, modifications, variations and other uses and applications will become apparent to those skilled in the art after considering this specification and the accompanying drawings. Therefore, any and all such changes, modifications, variations and other uses and applications which do not depart from the spirit and scope of the invention are deemed to be covered by the invention.

Having thus described the invention, what I desire to claim and secure by Letters Patent is:

1. A container assembly for storage and transport of large quantities of edible produce in substantially ready to eat form in such manner that risk of metal contamination of the produce is minimized, said container assembly comprising:

a) an outer peripheral carton side wall;

b) a bottom section secured to said side wall in such manner that the bottom section tightly engages the side wall with sufficient frictional force to hold a substantial weight of produce in the container assembly and eliminates need for metal fasteners to secure the bottom section to the side wall;

c) a flexible and foldable container disposed in said carton and initially having opposed gusseted side edges and having an initially open upper end for filling the container with produce;

d) means associated with said container to hermetically seal the initially open upper end by turning the upper end upon itself in the form of a roll extending entirely across the upper end and having several layers of the side wall rolled into that roll;

e) excess material sections on said side wall enabling formation of extended portions of the roll which initially extend substantially beyond the side wall of the container when the latter is filled with produce, said extended portions of the roll being folded back on top of the roll, thereby forming a closed top on the container with no portion of the roll extending beyond the side wall of the container, to thereby form an air-tight interior compartment in said container in which produce can be stored in a controlled atmosphere;

f) tape means for holding the extended portions on the roll or container top and for holding the roll on the top of the container in such manner to maintain the hermetic seal and which tape means is readily manually removable thereby permitting easy manual opening without the need for nor the requirement of a metal implement to open the upper end; and g) a lid for disposition over the upper end of said carton and which can be secured thereto without need for metal fasteners therefor.

2. The container assembly of claim 1 further characterize in that the flexible and foldable container is formed of a material which is relatively impervious to air.

3. The container assembly of claim 2 further characterized in that the container is formed of a plastic material.

4. The container assembly of claim 1 further characterized in that said lid and bottom section each has outwardly struck flanges which snugly engage the side wall of the carton.

5. The container assembly of claim 1 further characterized in that the tape means is an adhesive strip which secures the extended portions to the roll and the roll of material to the top wall.

6. A process for storing and transporting produce in such a manner that risk of metal contamination of the produce is minimized, said process comprising:

a) locating a carton bottom wall section under a paperboard container having a continuous side wall;

b) tightly engaging a flange on the carton bottom wall section with the lower end of the carton side wall to retentively hold the bottom wall section on the side wall without metal fasteners;

c) inserting a plastic container having a continuous side wall within the carton and opening the upper end thereof;

d) filling the container to a desired level with produce such that the container upper end has an excess of material which extends beyond the continuous side wall of the container when the latter is filled or at least partially filled with produce;

e) rolling the upper end of the container into a roll extending entirely across the upper end of the container and having several layers of the side wall rolled into that roll until it rests upon the upper surface of the container and to thereby enable closing of the container and to enable securement to the container;

f) forming extended portions of the roll from excess material on said side wall and which extended portions of the roll initially extend substantially beyond the side wall of the container when the latter is fill with produce;

g) folding the extended portions of the roll back on top of the roll thereby forming a closed top on the container with no portion of the roll extending beyond the side wall of the container, to thereby form an air-tight seal in the container and an air-tight interior compartment in which produce can be stored in a controlled atmosphere and which also permits easy manual opening without the need of a metal implement;

h) adhesively securing the extended portions on the roll or container top and holding the roll on the top of the container; and i) disposing a cover on the side wall of the carton with a peripheral flange snugly engaging the upper portion of the carton side wall.

7. The process of claim 6 further characterized in that said method comprises turning the roll about itself down to the level of produce in the container and forming a top wall of the container.

8. The process of claim 7 further characterized that the method comprises applying a releasable tape means to the roll of material and to the top wall.

* * * * *